United States Patent [19]

Archenholtz et al.

[11] Patent Number: 4,684,109

[45] Date of Patent: Aug. 4, 1987

[54] MELT-TRANSFER DEVICE FOR THE PROTECTED TAPPING OF MOLTEN METAL FROM ONE VESSEL TO ANOTHER

[75] Inventors: Åke Archenholtz; Kare Folgerö, both of Västerås, Sweden

[73] Assignee: ASEA Aktiebolag, Västerås, Sweden

[21] Appl. No.: 784,046

[22] Filed: Oct. 4, 1985

[30] Foreign Application Priority Data

Oct. 16, 1984 [SE] Sweden ..... 8405156

[51] Int. Cl.[4] ..... C21C 7/00

[52] U.S. Cl. ..... 266/216; 266/236

[58] Field of Search ..... 266/216, 248, 240, 81, 266/236, 275, 86, 93, 220, 213; 164/437, 438

[56] References Cited

U.S. PATENT DOCUMENTS

| | | | |
|---|---|---|---|
| 1,469,224 | 10/1923 | Ladd | 266/95 |
| 2,455,531 | 12/1948 | Stroman | 266/216 |
| 2,481,699 | 9/1949 | Stroman | 266/240 |
| 3,198,613 | 11/1965 | Shapiand, Jr. | 266/220 |
| 3,765,572 | 10/1973 | Neamann et al. | 164/438 |
| 4,360,190 | 11/1982 | Ato | 266/220 |

FOREIGN PATENT DOCUMENTS

| | | | |
|---|---|---|---|
| 0058999 | 9/1982 | European Pat. Off. | 266/216 |
| 2064123 | 7/1971 | France | 164/438 |

*Primary Examiner*—L. Dewayne Rutledge
*Assistant Examiner*—S. Kastler
*Attorney, Agent, or Firm*—Watson, Cole, Grindle & Watson

[57] ABSTRACT

A melt-transfer device for the protected tapping of molten metal from one vessel to another has a tiltable, cylindrical container with a lid, which is at least partially located in a first end wall in the container. The container is also provided with a melt-tapping pipe which is directed substantially tangentially to the container close to the first-mentioned end wall. In the bottom of the container, in a second end wall, a baffle can be arranged to provide a pocket for a magnesium-containing powder fed into the container through the lid when the container is held in a vertical position.

7 Claims, 11 Drawing Figures

MELT-TRANSFER DEVICE FOR THE PROTECTED TAPPING OF MOLTEN METAL FROM ONE VESSEL TO ANOTHER

BACKGROUND OF THE INVENTION

The present invention relates to a melt-transfer device for the protected tapping of molten metal from one vessel to another, such as from a ladle to a pouring furnace.

When tapping molten metal from one vessel to another, it is difficult to prevent slag floating on the molten metal from accompanying the melt; at the same time there is a risk that the metal and any alloying materials it contains will become oxidized during the tapping operation since the stream of molten metal (referred to as the "tapping jet" hereafter) leaving the device is exposed to oxygen in the atmosphere. In addition, relatively high temperature losses can occur during the tapping operation because of the free radiation of thermal energy from the molten metal that can occur.

The above-noted considerations give rise to a problem when, for example, nodular iron containing magnesium has to be tapped into a pouring furnace. During the tapping,magnesium can be oxidized in the order of magnitude of 0.005–0.010%, while at the same time surface slag, largely consisting of FeO, $SiO_2$ and MnO, is tapped into the furnace with the molten metal. This slag will adhere to the furnace lining or float up to the surface and is reduced by magnesium to form difficulty fusible slags which contain MgO. The formation of these modified slags results both in additional magnesium losses and in problems of the slag clogging passages in the furnace. Clogging can be a particular problem in the case of a channel-type pouring furnace.

One object of this invention is to provide a solution to the above-mentioned problems and other problems associated therewith.

SUMMARY OF THE INVENTION

According to the invention, a melt transfer device includes a tiltable cylindrical container which is provided with a lid, that is at least partially located in a first end wall of the container. At the other end or bottom of the container, at a second end wall surface, there may be arranged means to screen off a volume for containing a magnesium-containing powder fed into the volume through the lid when the container is in a vertical position. The container further includes a melt-tapping pipe which is directed substantially tangentially to the container adjacent to the first end wall. By making the tilting axis of the container extend through the melt-tapping pipe, the tapping jet created when melt in the container is poured out therefrom, can be kept short and can be enclosed within a protective hood. Thus, the previous drawbacks associated with the transfer of melt between two vessels can be eliminated by ensuring that tapping occurs through a space in which an inert atmosphere, for example of nitrogen gas ($N_2$), can be maintained.

To permit slags dispersed in molten metal to be separated therefrom, the container can be subjected to rocking or swinging motions so that velocity differences arise in the molten metal, causing small slag particles to coalesce into larger particles which, according to Stoke's law, will more readily float to the free surface of the melt. The container can be mounted so that it can be rotated into a horizontal position, which further reduces the float-up time of the slag particles.

The container can be tilted at a controlled speed during tapping so that the level of molten metal is all the time maintained above the tap hole. This prevents surface slag flowing out with the molten metal. The entire tapping operation can be automated.

BRIEF DESCRIPTION OF THE DRAWINGS

The invention will now be further described, by way of example, with reference to the accompanying drawings, in which.

DESCRIPTION OF PREFERRED EMBODIMENT

Figure 1:
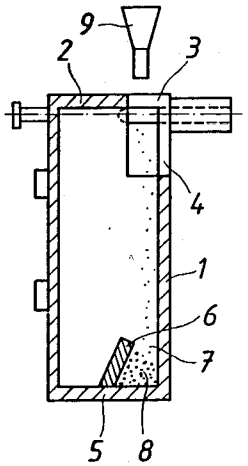
FIG. 1 shows the addition of a magnesium-containing powder to a melt-transfer device according to the invention.

FIG. 1 shows, schematically, a melt-transfer device according to the invention having a cylindrical container 1 lined with refractory material (not shown). At one end wall 2 the container 1 is provided with an openable lid 3, which includes part of the end wall 2 and/or the adjoining cylindrical surface (at 4). On the opposite end wall 5 of the container 1 a refractory baffle 6 is disposed, which screen extends diametrically across the bottom of the container in a direction inclined to the longitudinal axis of the container. The baffle 6 demarks a volume or pocket 7 in a part of the bottom of the container. A magnesium-containing powdered material 8, such as powdered ferro-silicon magnesium (e.g. with a magnesium content of 5–10% and grain size diameters in the range of 1–10 mm), is intended to be fed into the pocket 7 via the opening at the lid 3. The powder is shown being fed in from a container 9 in FIG. 1.

To obtain low total magnesium losses for the melt tapping process, the container is used as a treatment ladle for magnesium alloying while the melt transfer takes place. This can be done in various well-known ways, one of which involves the use of the pocket 7 in the bottom of the container. Basic iron, such as iron containing 3.6–3.9% C, 1.5–2.5% Si, the balance being Fe, is fed into the container when the container 1 is in a horizontal position so that the molten metal is kept away from the powder at this stage. The alloying reaction starts when the container 1 is turned back into the vertical position. Operating in this way, it is possible to maximize the yield of magnesium, since substantially the entire charge of iron is flushed by magnesium vapor from the very beginning of the reaction.

Figure 3:
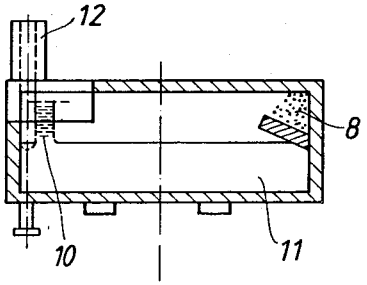
FIG. 3 shows the device of FIG. 2 after having been provided with a charge of molten basic iron.
Figure 3A:
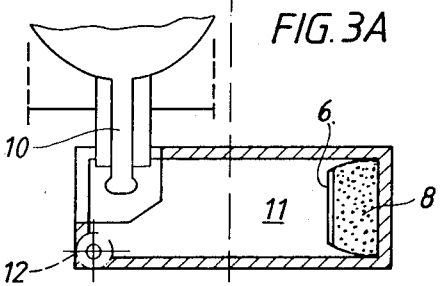
FIG. 3A shows FIG. 3 in plan from above.
Figure 2:
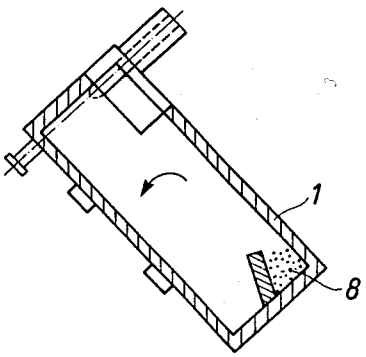
FIG. 2 shows the device of FIG. 1 in a rotated position.

Thus, an alloying powder (e.g. of the above-mentioned kind) is fed into the pocket 7 according to FIG. 1. Thereafter, the container 1 is rotated to the horizontal position through the position shown in FIG. 2, keeping the powder charge in the pocket 7. When the horizontal position has been achieved (according to FIG. 3), basic iron 11 is tapped in from a channel 10, through the opening provided by the lid 3. However, the melt filling can, of course, also be effected by means of a tapping spout (not shown) provided in an opening in the end wall 2, or even via a tangentially directed melt-tapping pipe 12 provided for emptying the container.

Figure 4:
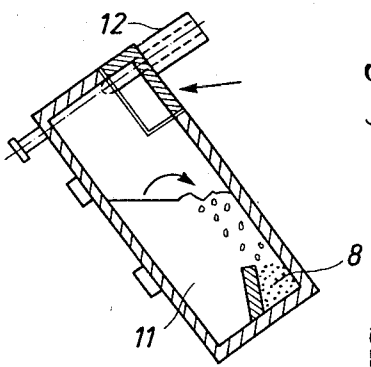
FIG. 4 shows the device of FIG. 3 rotated towards a vertical position.

FIG. 4 shows the container partly rotated back to the upright position after the lid 3 has been closed. As thi rotation ocurs, the reaction between the basic iron 11 and the powder 8 is initiated and the formation of nodular iron commences.

Figure 5:
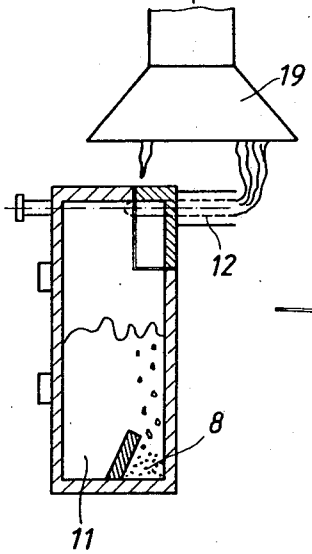
FIG. 5 shows the device of FIG. 4 in the vertical position and with fumes therefrom being sucked away.

The reaction continues as shown in FIG. 5. The tangentially directed melt-tapping pipe 12, of the container, is located below a cowl 19 and extraction of gases from the container 1 is performed by suction applied to the cowl 19 acting through the pipe 12. The longitudinal axis of the melt-tapping pipe 12 makes an angle of 90° with the longitudinal axis of the container 1.

The container 1 can also be used for other treatment processes for nodular iron, for example for the introduction of a treatment alloy via an immersion ladle. In this case the baffle 6 is not required, although the upper part of the container 1 will have to be adapted to operate the immersion ladle method.

Figure 6:
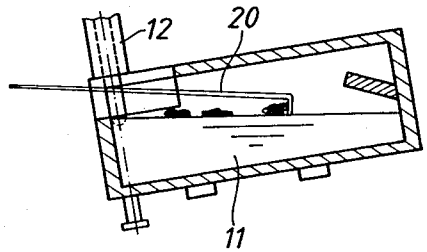
FIG. 6 shows deslagging of the device.

Deslagging of the contents of the container can take place using a rake 20 inserted via the opening formed when the lid 3 is removed (e.g. after tilting in the manner shown in FIG. 6).

Figure 8:
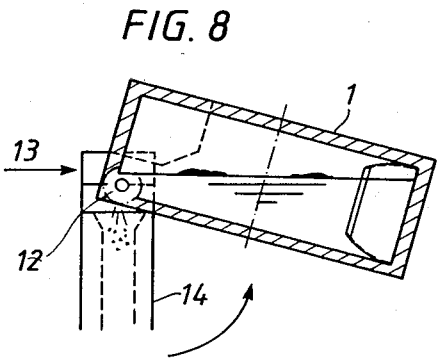
FIG. 8 shows protected tapping of melt from the device into a furnace and FIG. 8A shows FIG. 8 in plan from above.
Figure 8A:
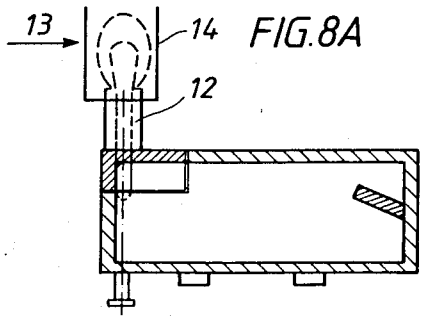
Figure 7:
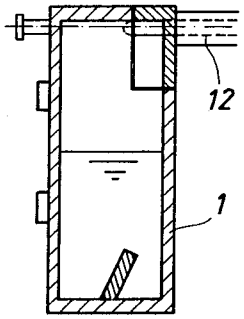
FIG. 7 shows the device during transportation to a pouring furnace.

Transportation of the modular iron to a pouring furnace can take place as shown in FIG. 7, the container axis being vertical. FIG. 8 shows protected tapping of melt from the container 1 to a pouring furnace 14. The tapping is performed by means of the melt-tapping pipe 12 and suitably is carried out in a protective atmosphere, for example of $N_2$ (fed in at 13).

The melt-tapping pipe 12 of the container 1 should be tangentially directed and should also have such a length that it reaches into a hood or other protective device in the pouring furnace, which enables the entire tapping operation from the container 1 to the furnace (as well as the storage of the melt in the container 1) to be performed in a protected manner.

Figure 9:
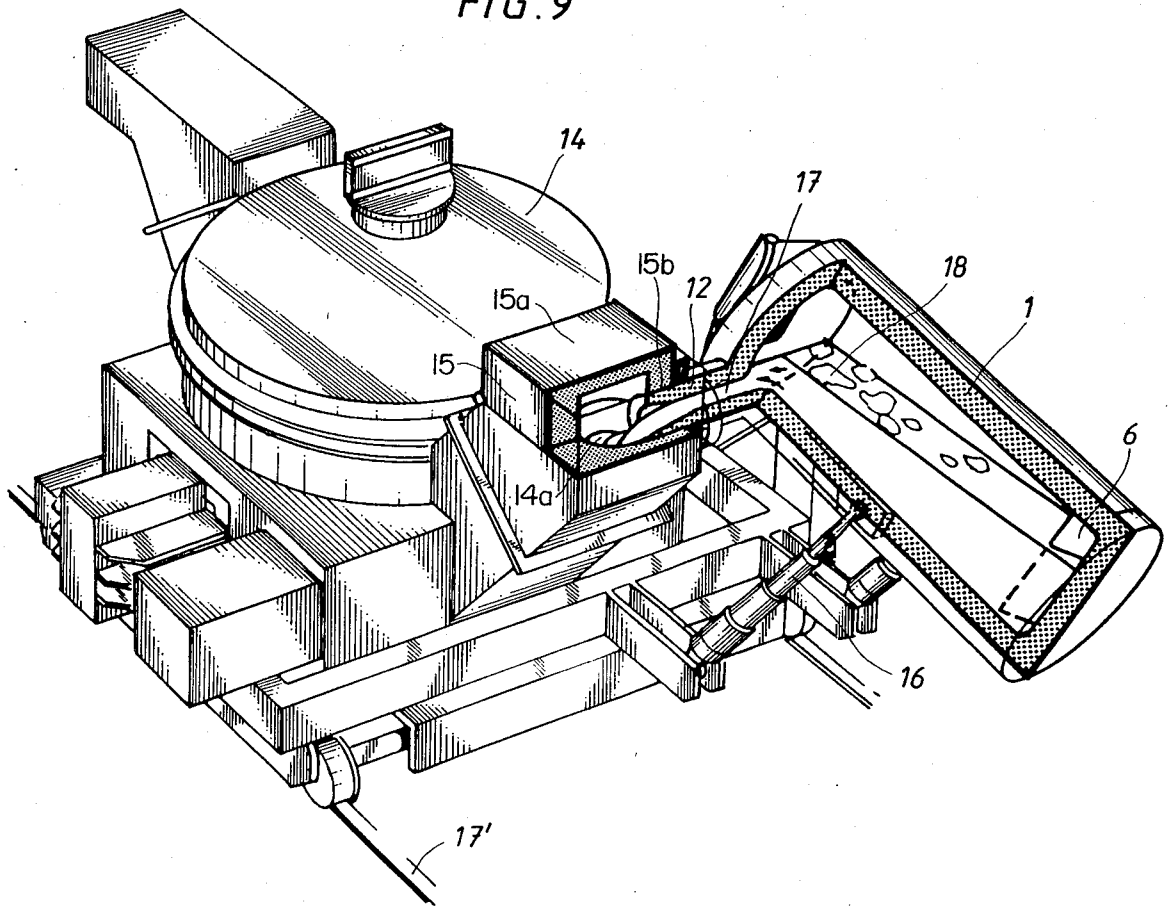
FIG. 9 is a partially broken-away perspective view of a device according to the invention showing melt being tapped into a pouring furnace.

FIG. 9 shows tapping of melt into a channel-type pouring furnace 14, the melt-tapping pipe 12 from the container 1 extending into a side opening **15*b* and below the top wall 15*a* of a protective hood 15 forming a part of the pouring furnace 14**.

The container 1 is tiltable about the longitudinal axis of the pipe 12 by means of lifting cylinders 16. The tilting should be performed at such a speed that the melt level in the container 1 is always above the uppermost part of the outflow opening 17 of the pipe 12 in order to prevent surface slag 18 from accompanying the molten metal into the furnace 14.

The furnace 14 can be transportable on rails 17' or otherwise movable as required.

During the removal of gases by suction (see FIG. 5), magnesium is alloyed into the melt.

Prior to start-up of the reaction between the basic iron 11 and the powder 8 (see FIG. 4), the lid 3 is closed to limit the access of air or oxygen to the melt.

Preferably, the container 1 is arranged so that the atmosphere contained therein can be maintained until the next stage of the operation.

The invention can be varied in many ways within the scope of the following claims.

What is claimed is:

1. A combined pouring furnace and melt-transfer device for supplying slag-free molten metal into said pouring furnace, said pouring furnace including a receiving channel and a protective hood thereover, said protective hood including a top wall and a side opening for receiving a melt-tapping pipe, and said melt-transfer device comprising a cylindrical container having a cylinder side wall and first and second end walls, said first end wall having an opening therein, said cylindrical container defining a first longitudinal axis therethrough, a lid covering said opening in said first end wall, a baffle mounted on said second end wall to extend within said container and define a pocket which can contain a powder which has been fed through said opening in said first end wall when said cylindrical container is oriented such that its first longitudinal axis is vertically oriented, a melt-tapping pipe connected to said cylindrical axis side wall near said first end wall, said melt-tapping-pipe extending substantially tangentially away from said cylindrical side wall and perpendicularly with respect to said first longitudinal axis of said cylindrical container, said melt-tapping pipe providing an outlet channel therethrough and defining a second longitudinal axis, said melt-tapping pipe extending within said opening and below said top wall of said protective hood of said pouring furnace during melt tapping, and pivot means connected between said pouring furnace and said cylindrical container to support said cylindrical container and to cause it to tilt about said second longitudinal axis such that molten metal in said cylindrical container can flow through said melt-tapping pipe and into said receiving channel in said pouring furnace in a protected manner.

2. The combined pouring furnace and melt-transfer device as defined in claim 1, wherein said baffle is connected to said second end wall so as to extend along the diameter of said second end wall.

3. The combined pouring furnace and melt-transfer device as defined in claim 2, wherein said baffle is inclined with respect to said first longitudinal axis.

4. The combined pouring furnace and melt-transfer device as defined in claim 1, wherein said pivot means comprises two lifting cylinders connected to said cylindrical side wall, said lifting cylinders being capable of tilting said cylindrical container about said second longitudinal axis such that the outlet channel in said melt-tapping pipe is always filled with melt.

5. The combined pouring furnace and melt-transfer device as defined in claim 4, including control means for automatically controlling said lifting cylinders to maintain the output channel in said melt-tapping pipe full of melt during the tapping operation.

6. The combined pouring furnace and melt-transfer device as defined in claim 1, including means for feeding a protective gas into said receiving channel in said pouring furnace.

7. The combined pouring furnace and melt-transfer device as defined in claim 1, wherein said cylindrical side wall has an opening which merges with the opening in said first end wall, and wherein said lid can also cover said opening in said cylindrical side wall.

* * * * *